United States Patent [19]

Ona et al.

[11] Patent Number: 4,978,363

[45] Date of Patent: Dec. 18, 1990

[54] FIBER-TREATMENT ORGANO-FUNCTIONAL POLYSILOXANES AGENT COMPOSITION

[75] Inventors: Isao Ona; Masaru Ozaki; Hidetoshi Kurusu, all of Chiba, Japan

[73] Assignee: Toray Silicone Company, Ltd., Tokyo, Japan

[21] Appl. No.: 357,821

[22] Filed: May 26, 1989

[30] Foreign Application Priority Data

May 30, 1988 [JP] Japan ..... 132155

[51] Int. Cl.[5] ..... C09B 67/00

[52] U.S. Cl. ..... 8/581; 8/DIG. 1; 252/8.6; 252/8.75; 427/387; 427/393.3

[58] Field of Search ..... 252/86, 8.75; 8/DIG. 1, 8/581; 427/387, 393.3

[56] References Cited

U.S. PATENT DOCUMENTS 4,247,592 1/1981 Kalinowski ..... 428/266

4,585,563 4/1986 Busch et al. ..... 252/8.8

*Primary Examiner*—Paul Lieberman

*Assistant Examiner*—John F. McNally

*Attorney, Agent, or Firm*—George A. Grindahl

[57] ABSTRACT

A composition and method for treating fibers is based on a mixture of an organopolysiloxane having at least one amino-substituted hydrocarbon radical directly bonded to a silicon atom and a higher fatty carboxylic acid. The carboxylic acid reacts with the amino radicals to reduce yellowing and oxidation of the fiber treatment. The composition and method provide non-yellowing fibers and a treatment agent that does not gel during use, such as when exposed to carbon dioxide and/or used to treat carbon fibers.

8 Claims, No Drawings

FIBER-TREATMENT ORGANO-FUNCTIONAL POLYSILOXANES AGENT COMPOSITION

BACKGROUND OF THE INVENTION

The present invention relates to a fiber-treatment agent composition. Fiber-treatment agents based on organopolysiloxane containing the group represented by the formula $-CH_2CH_2CH_2NHCH_2CH_2NH_2$ have been used to impart lubricity to fibrous materials composed of natural fibers such as cotton, flax, silk, wool, angora, and mohair; regenerated fibers such as rayon and Bemberg; semisynthetic fibers such as acetate; and synthetic fibers such as polyesters, polyamides, polyacrylonitriles, polyvinyl chlorides, Vinylon, polyethylenes, polypropylenes, and Spandex. Refer to Japanese Patent Publication Number 57-43673 (43,673/82). However, fibers treated with such an organopolysiloxane containing the group represented by the formula $-CH_2CH_2CH_2NHCH_2CH_2NH_2$ are subject to yellowing due to a spontaneous oxidation occurring with time. Moreover, when continuous lubrication using rollers is carried out from a bath containing such an organopolysiloxane lubricant, moisture and carbon dioxide are absorbed from the atmosphere, and a white turbidity appears in the bath and the precipitation of a gel occurs. Furthermore, when such an organopolysiloxane is used for high-temperature oiling or lubrication as in the treatment of carbon fiber, for example polyacrylonitrile-based carbon fiber, the organopolysiloxane is degraded by heat to a gum, which sticks on the rollers, etc. This has the unfortunate effect of causing the fiber to snap.

BRIEF SUMMARY OF THE INVENTION

The present invention, having as its object a solution to the aforementioned problems, introduces a fiber-treatment agent which not only imparts excellent lubrication and softness, but which also does not yellow the fibrous material and is not subject to gelation or gum formation or the development of a white turbidity during storage, treatment, or heating.

The aforesaid object is achieved by means of a fiber-treatment agent composition comprising (A) an organopolysiloxane represented by the formula

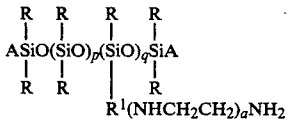

wherein R is a monovalent hydrocarbon group; A is an R group or a group with the formula $-R^1(NHCH_2CH_2)_aNH_2$; $R^1$ is a divalent hydrocarbon group; a=zero to 10; p and q are zero or more; with the proviso that p+q=10 to 2,000, and there is at least one $-R^1(NHCH_2CH_2)_aNH_2$ group in each molecule; and (B) 0.2 to 1.3 moles per 1 mole primary and secondary amino groups in component (A) of a higher fatty acid having 10 to 20 carbon atoms.

To explain the preceding in greater detail, component (A) is an organopolysiloxane as represented by the folloWing general formula and which has at least 1 $-R^1(NHCH_2CH_2)_aNH_2$ group in each molecule.

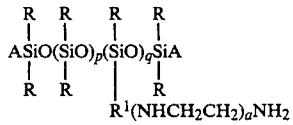

In the above organopolysiloxane formula R is a monovalent hydrocarbon group; A is a group R or a group with the formula $-R^1(NHCH_2CH_2)_aNH_2$; $R^1$ is a divalent hydrocarbon group; a=zero to 10; p and q are zero or at least 1; with the proviso that p+q=10 to 2,000.

R in the formula is a monovalent hydrocarbon group, as exemplified by alkyl groups such as methyl, ethyl, propyl, and butyl; aralkyl groups such as 2-phenylethyl and 2-phenylpropyl; halogen-substituted alkyl groups such as 3,3,3-trifluoropropyl; alkenyl groups such as vinyl, propenyl, and butadienyl; cycloalkyl groups such as cyclohexyl; aryl groups such as phenyl and naphthyl; and alkaryl groups such as tolyl and xenyl. Alkyl, alkenyl, and aryl groups are preferred. Furthermore, within a single molecule, R may be only a single species or may comprise different species.

$R^1$ is a divalent hydrocarbon group, and examples in this regard are alkylene groups such as methylene, n-propylene, n-butylene, isobutylene, and isopropylene; arylene groups such as phenylene; and alkylenearylene groups such as ethylenephenylene. Alkylene is typically selected from among these. The value of a is zero to 10, and p and q are numbers with values of zero or at least 1.

A is an R group or $-R^1(NHCH_2CH_2)_aNH_2$. When both of the two groups A are a group represented by the formula $-R^1(NHCH_2CH_2)_aNH_2$, q may be zero.

Furthermore, the value of p+q is to be 10 to 2,000. The basis for this is as follows. Only a meager softness and smoothness are imparted to the fibrous material at values below 10, while emulsification becomes difficult at values in excess of 2,000.

Considering the structure of component (A), it is the diorganopolysiloxane moiety which functions to develop softness and smoothness, while the amino group moiety functions to form a salt with the higher fatty acid comprising component (B).

The higher fatty acid comprising component (B) should contain 10 to 20 carbon atoms, and this component may be a saturated or unsaturated higher fatty acid. Fatty acid having no more than 2 carbon atoms is readily evaporated by heat treatment at or below 150 degrees Centigrade, while fatty acid having 3 to 9 carbon atoms incurs a deterioration in the hand. In addition, dicarboxylic and tricarboxylic acids cannot be used in the present invention due to a crosslinking reaction with the organopolysiloxane comprising component (A).

The component (B) under consideration is concretely exemplified by capric acid, undecylic acid, lauric acid, tridecylic acid, myristic acid, pentadecylic acid, palmitic acid, heptadecylic acid, stearic acid, nonadecanoic, arachidic acid, elaidic acid, linolic acid, and linolenic acid.

Component (B) is to be blended into the composition of the present invention at 0.2 to 1.3 moles per 1 mole primary and secondary amino groups in component (A). The suppression of yellowing and the suppression of gel formation and the development of white turbidity are absent at less than 0.2 moles component (B). Furthermore, the hand becomes poor at more than 1.3 moles.

The composition of the present invention may be prepared by simply mixing components (A) and (B) to homogeneity. However, when component (B) is a solid at room temperature, mixing with component (A) is preferably carried out with melting by heating at least to the former's melting point or after dissolution in an organic solvent.

The composition of the present invention can be directly adhered as such on fibrous materials, but treatment may also be conducted with it dissolved in an organic solvent, for example, toluene, xylene, benzene, n-hexane, heptane, acetone, methyl ethyl ketone, methyl isobutyl ketone, ethyl acetate, butyl acetate, mineral turpentine, perchloroethylene, trichloroethylene, etc. Treatment may also be conducted with it emulsified using a cationic and/or nonionic surfactant.

Examples of cationic surfactants in this regard are quaternary ammonium hydroxides (and salts thereof) such as octyltrimethylammonium hydroxide, dodecyltrimethylammonium hydroxide, hexadecyltrimethylammonium hydroxide, octyldimethylbenzylammonium hydroxide, decyldimethylbenzylammonium hydroxide, didodecyldimethylammonium hydroxide, dioctadecyldimethylammonium hydroxide, beef tallow trimethylammonium hydroxide, and cocotrimethylammonium hydroxide.

Examples of nonionic surfactants in this regard are polyoxyalkylene alkyl ethers, polyoxyalkylene alkylphenol ethers, polyoxyalkylene alkyl esters, polyoxyalkylene sorbitan alkyl esters, polyethylene glycols, polypropylene glycols, and diethylene glycol.

The surfactant is preferably used at 5 to 50 weight parts and more preferably at 10 to 30 weight parts per 100 weight parts organopolysiloxane comprising component (A).

While water may be used in arbitrary quantities and its use quantity is not crucial, in general it will be used in a quantity affording an organopolysiloxane concentration of 5 to 60 weight%. It is particularly preferred that water be used in a quantity giving an organopolysiloxane concentration of 10 to 40 weight%.

To emulsify the composition of the present invention, the surfactant as described above and a small quantity of the water are added to and mixed to homogeneity into the mixture of components (A) and (B). This may then be emulsified using an emulsifying device such as an homogenizer, colloid mill, line mixer, propeller mixer, vacuum emulsifier, or similar devices.

Furthermore, the composition of the present invention may also contain other additives as known to the art, such as antistatics, softeners, creaseproofing agents, heat stabilizers, flame retardants, etc.

The fibrous material can be treated using methods such as spray adhesion, roll application, brushing, immersion, dipping, etc. The add-on or uptake quantity will vary with the fibrous material and thus cannot be rigorously specified; however, in general it will fall within the range of 0.01 to 10.0 weight% as organopolysiloxane fraction based on fibrous material. The fibrous material is then allowed to stand at the ambient temperature, subjected to a hot air flow, or is heat treated, or the like.

The fibrous material may be composed of, for example, natural fiber such as wool, silk, flax, cotton, angora, mohair, and asbestos; regenerated fiber such as rayon and Bemberg; semisynthetic fiber such as acetate; synthetic fiber such as polyesters, polyamides, polyacrylonitriles, polyvinyl chlorides, Vinylon, polyethylenes, polypropylenes, and Spandex; and inorganic fiber such as glass fibers, carbon fibers, and silicon carbide fibers. It may take the form of, for example, the staple, filament, tow, top, or yarn, and in its structure may be, for example, a weave, knit, or nonwoven fabric.

EXAMPLES

The present invention is explained in greater detail, but not limited, in the following by illustrative examples. In the examples, unless specified otherwise, parts = weight parts, % = weight%, and the viscosity is the value measured at 25 degrees Centigrade.

EXAMPLE 1

Treatment baths (a) through (f) were prepared by blending toluene (diluting solvent), siloxane A and stearic acid as reported in Table 1.

$$(CH_3)_3SiO\{(CH_3)_2SiO\}_{400}\{CH_3SiO\}_8Si(CH_3)_3 \quad \text{(siloxane A)}$$
$$\qquad\qquad\qquad\qquad\qquad\qquad |$$
$$\qquad\qquad\qquad\qquad\qquad\quad C_3H_5$$
$$\qquad\qquad\qquad\qquad\qquad\qquad |$$
$$\qquad\qquad\qquad\qquad\qquad HNCH_2CH_2NH_2$$

TABLE 1

| Components | formulation (parts) (a) | (b) | (c) | (d) | (e) | (f) |
|---|---|---|---|---|---|---|
| Siloxane A | 9.2 | 9.2 | 9.2 | 9.2 | 9.2 | 0 |
| Stearic acid | 1.2 | 0.8 | 0.4 | 0.1 | 0 | 0 |
| Toluene | 990.0 | 990.0 | 990.4 | 990.7 | 990.8 | 1000 |
| molar ratio: higher fatty acid to amino groups in siloxane A | 1.5 | 1 | 0.5 | 0.1 | 0 | — |

A fluorescent-whitened 100% cotton knit (50 cm × 50 cm) was immersed for 10 seconds in the particular treatment bath. After removal, a 100% expression ratio was obtained using squeeze rollers. It was subsequently spread out and dried at room temperature (siloxane A add-on = 0.9%), and was then heat-treated for 3 minutes in a hot-air drier at 130 degrees Centigrade and removed. The knit was then cut in two through the middle, and the hand was sensorially inspected using one specimen. A 10 cm x 10 cm sample was cut from the other fabric specimen in each case, and this was heat treated for 5 minutes in an oven at 180 degrees Centigrade and removed. The degree of yellowing was compared using a discoloration/fading gray scale based on JIS L-0804.

As reported in Table 2, fabric treated with treatment agent of the present invention ((b) and (c)) had excellent properties, with an excellent hand and very little yellowing.

TABLE 2

| Treatment Liquid | | Hand | Yellowing |
|---|---|---|---|
| Present Invention | (b) | excellent hand, extension/recovery is excellent, wrinkles only with difficulty, excellent as underwear | 4 (slight) |
| | (c) | excellent hand, extension/recovery is excellent, wrinkles only with difficulty, excellent as underwear | 4 |
| Compare Examples | (a) | a suitable degree of slickness is absent, unsuitable as underwear | 4 |
| | (d) | remarkably good hand | 2–3 (substan- |

TABLE 2-continued

| Treatment Liquid | Hand | Yellowing |
|---|---|---|
| | | tial) |
| (e) | remarkably good hand | 2 (substantial) |
| (f) | rough and hard, extension/recovery is poor, easily wrinkles | 4–5 (slight) |

EXAMPLE 2

The following treatment liquids were prepared in order to investigate the high-temperature stability which is an essential property in lubricants for polyacrylonitrile-based carbon fibers. The components are given in Table 3, and the siloxane A was the same as used in Example 1 (higher fatty acid/amino groups in siloxane A molar ratio=1).

Preparation of the treatment liquids

Siloxane A was placed in a 300 cc four-neck flask, the higher fatty acid as specified in Table 3 was then added, and a nitrogen seal was set up. Mixing to homogeneity was carried out at room temperature over 2 hours, with the exception of treatment liquids (g) through (i), where mixing was carried out with heating to 80 degrees Centigrade because these higher fatty acids were solid at room temperature. The obtained treatment liquids (g) through (o) were emulsified as detailed below to prepare the respective emulsions.

Emulsion components:

| | |
|---|---|
| treatment liquid (g) through (o) | 20.0 parts |
| polyoxyethylene (6 moles) ether of trimethylnonanol | 4.0 parts |
| polyoxyethylene (10 moles) ether of trimethylnonanol | 1.0 part |
| water | 75.0 parts |

Emulsification method:

The two emulsifying agents were added to a treatment liquid (g) through (o), and this was mixed with a stirrer for 10 minutes. Five parts water was then added, followed by mixing for an additional 10 minutes. The remaining 70 parts water was then added, and mixing for 30 minutes afforded the emulsion.

Four grams of the particular emulsion prepared as described above was placed in an aluminum cup (diameter=5 cm, depth =1.5 cm), and a gelation test was conducted by varying the time held at 150 degrees Centigrade. Evaluation was conducted as follows.

+ =remains as an oil, almost no change in viscosity, no gel development

− =substantial increase in viscosity, partial gel development

× =completely gelled, no longer, converted to a strongly sticky gel

These results are reported in Table 4. The treatment agent compositions of the present invention gave unusually good results and did not undergo gelation.

TABLE 3

| Components | formulation (parts) | | | | | | | | |
|---|---|---|---|---|---|---|---|---|---|
| | (g)* | (h)* | (i)* | (j)* | (k)* | (l) | (m) | (n) | (o) |
| Silioxane A | 92.0 | 93.0 | 94.0 | 94.8 | 92.0 | 96.0 | 98.0 | 98.7 | 100 |
| Acid | | | | | | | | | |
| Stearic | 8.0 | — | — | — | — | — | — | — | — |
| Palmitic | — | 7.0 | — | — | — | — | — | — | — |
| Lauric | — | — | 6.0 | — | — | — | — | — | — |
| Undecylenic | — | — | — | 5.2 | — | — | — | — | — |
| Oleic | — | — | — | — | 8.0 | — | — | — | — |
| Caproic | — | — | — | — | — | 4.0 | — | — | — |
| Acetic | — | — | — | — | — | — | 2.0 | — | — |
| Formic | — | — | — | — | — | — | — | 1.3 | — |
| None | — | — | — | — | — | — | — | — | 0 |

*This invention.

TABLE 4

| Treatment Liquid | | Holding Time in Hours at 150 degrees Centigrade | | |
|---|---|---|---|---|
| | | 1 | 5 | 8 |
| Present Invention | (g) | + | + | + |
| | (h) | + | + | + |
| | (i) | + | + | + |
| | (j) | + | + | + |
| | (k) | + | + | + |
| Comparison Examples | (l) | + | − | × |
| | (m) | + | × | × |
| | (n) | + | × | × |
| | (o) | + | × | × |

EXAMPLE 3

Treatment baths were respectively prepared by the addition of 95 parts water to 5 parts of the emulsion of (g) or (1) as prepared in Example 2. A fluorescent-whitened commercial 100% cotton broadcloth (30 cm ×30 cm) was dipped into each treatment bath for 10 seconds. After expressing to a 100% expression ratio on a mangle roll, drying was carried out at room temperature (silicone uptake=1%). This was followed by heat treatment by placing the fabric in an oven for 3 minutes at 130 degrees Centigrade. The hand of this treated fabric was then examined sensorially. A 5 cm ×10 cm specimen was next cut from the treated fabric. Covering half with black paper, the degree of yellowing was evaluated (ranked) using a discoloration/fading gray scale based on JIS L-0804 upon exposure to light for 3 hours in a Fade-O-Meter lightfastness measurement instrument. According to Table 5, the fabric treated with the treatment agent of the present invention gave excellent results, with an excellent hand and little yellowing due to light.

TABLE 5

| Treatment Liquid | | Hand | Yellowing (rank) by Fade-O-Meter Exposure |
|---|---|---|---|
| Present Invention | (g) | soft, but not limp; very suitable as broadcloth; appropriate degree of slickness | 4 |
| Comparison Examples | (1) | soft, but not limp; very suitable as broadcloth; appropriate degree of slickness | 2 |
| | no treat-ment | hard, the hand is very poor, also lacking in resilience | 4 |

Effects of the Invention

The present invention introduces a fiber-treatment agent which can impart an excellent lubricity and softness without causing the fibrous material to yellow, and which does not undergo gelation or gum formation or the development of white turbidity during storage, treatment, or heating.

That which is claimed is:

1. A fiber-treatment agent composition consisting essentially of from about 1 to 100 percent by weight, based on the weight of the composition, of the reaction product of (A) an organopolysiloxane represented by the formula

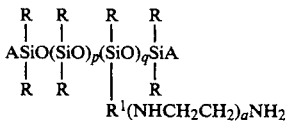

wherein R is a monovalent hydrocarbon group; A is and R group or a group with the formula $-R^2(NHCH_2CH_2)_aNH_2$: $R^1$ is a divalent hydrocarbon group; a=zero to 10; p and q are zero or more; with the proviso that p+q=10 to 2,000, and there is at least one $-R^1(NHCH_2CH_2)_2NH_2$ group in each molecule; and (B) 0.2 to 1.3 moles per 1 mole primary and secondary amino groups in component (A) of a higher fatty acid having 10 to 20 carbon atoms.

2. A fiber-treatment agent composition according to claim 1 wherein (A) has the formula

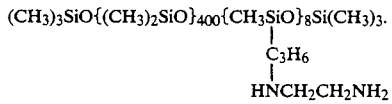

3. A fiber-treatment agent composition according to claim 1 wherein component (B) is a saturated higher fatty acid.

4. A fiber-treatment agent composition according to claim 1 wherein component (B) is an unsaturated higher fatty acid.

5. A process for providing treated fibers, said process comprising treating said fibers with the fiber-treatment agent composition of claim 1.

6. A process for providing treated fibers, said process comprising treating said fibers with the fiber-treatment agent composition of claim 2.

7. A process for providing treated fibers, said process comprising treating said fibers with the fiber-treatment agent composition of claim 3.

8. A process for providing treated fibers, said process comprising treating said fibers with the fiber-treatment agent composition of claim 4.

* * * * *